US010734143B2

(12) United States Patent
Fujikawa et al.

(10) Patent No.: US 10,734,143 B2
(45) Date of Patent: Aug. 4, 2020

(54) R-T-B BASED SINTERED MAGNET

(71) Applicant: TDK CORPORATION, Tokyo (JP)

(72) Inventors: Yoshinori Fujikawa, Tokyo (JP); Masashi Miwa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 176 days.

(21) Appl. No.: 15/940,049

(22) Filed: Mar. 29, 2018

(65) Prior Publication Data

US 2018/0301257 A1 Oct. 18, 2018

(30) Foreign Application Priority Data

Mar. 30, 2017 (JP) ..... 2017-069156
Mar. 22, 2018 (JP) ..... 2018-055202

(51) Int. Cl.

| | |
|---|---|
| ***H01F 41/02*** | (2006.01) |
| ***H01F 1/057*** | (2006.01) |
| ***C22C 38/00*** | (2006.01) |
| ***C22C 38/06*** | (2006.01) |
| ***C22C 38/10*** | (2006.01) |
| ***C22C 38/16*** | (2006.01) |
| ***C22C 38/14*** | (2006.01) |

(52) U.S. Cl.

CPC ..... *H01F 1/0577* (2013.01); *C22C 38/002* (2013.01); *C22C 38/005* (2013.01); *C22C 38/06* (2013.01); *C22C 38/10* (2013.01); *C22C 38/14* (2013.01); *C22C 38/16* (2013.01); *H01F 1/0576* (2013.01); *H01F 41/0293* (2013.01); *C22C 2202/02* (2013.01); *H01F 41/0266* (2013.01)

(58) Field of Classification Search

None

See application file for complete search history.

(56) References Cited

U.S. PATENT DOCUMENTS

2008/0245442 A1 10/2008 Nakamura et al.
2011/0150691 A1 6/2011 Nakamura et al.
2018/0286545 A1* 10/2018 Fujikawa ..... H01F 1/0577

FOREIGN PATENT DOCUMENTS

JP S59-46008 A 3/1984
JP 2016154219 A 8/2016
WO 2006043348 A1 4/2006

OTHER PUBLICATIONS

Li et al., Japanese Journal of Applied Physics, vol. 47, p. 7876-7878. (Year: 2008).*

Bao, Xiao-qian et al. "Microstructural study on Nd—Fe—B permanent magnets prepared by hot isostatic pressing sintering". No. 4(35), p. 432-433. Dec. 31, 2004.

* cited by examiner

*Primary Examiner* — Xiaowei Su

(74) *Attorney, Agent, or Firm* — Oliff PLC

(57) ABSTRACT

An R-T-B based sintered magnet including a main phase particle comprising an $R_2T_{14}B$ type crystal structure. R is at least one rare earth element, T is at least one transition metal element essentially including Fe or Fe and Co, and B is boron. The R-T-B based sintered magnet includes a magnet surface layer part and a magnet central part existing inside the magnet surface layer part. A crystal orientation degree of the main phase particle in the magnet surface layer part having a magnetic pole surface is lower than the crystal orientation degree of the main phase particle in the magnet central part.

11 Claims, 2 Drawing Sheets

R-T-B BASED SINTERED MAGNET

BACKGROUND OF THE INVENTION

1. Field of the Invention

The present invention relates to an R-T-B based sintered magnet.

2. Description of the Related Art

As disclosed in Patent Document 1, it is known that the R-T-B based sintered magnet has excellent magnetic properties. At present, further improvement of the magnetic properties is desired.

As a method for improving the magnetic properties, particularly coercive force, of the R-T-B based sintered magnet, a method of adding a heavy rare earth element as R (a one-alloy method) when producing the raw material alloy is known. Further, there is a method (a two-alloy method) of pulverizing a main phase alloy not including the heavy rare earth elements and a grain boundary phase alloy including the heavy rare earth elements, then mixing and sintering thereof. Furthermore, as disclosed in Patent Document 2, there is a method (a grain boundary diffusion method) of diffusing the heavy rare earth elements via grain boundaries by adhering the heavy rare earth elements on the surface and heating thereof after producing the R-T-B based sintered magnet.

According to the above one alloy process, a maximum energy product may be lowered in some cases due to the heavy rare earth elements existing in the main phase particle. According to the two-alloy method, it is possible to reduce the heavy rare earth elements in the main phase particle and to suppress a decrease in the maximum energy product. In the grain boundary diffusion method, it is possible to increase the concentration of the heavy rare earth elements only in a region close to the grain boundary among the main phase particles, and to reduce the concentration of the heavy rare earth elements inside the main phase particle. That is, main phase particles having a general core-shell structure can be obtained. A general core-shell structure is a structure in which the concentration of the heavy rare earth elements in the core part is lower than the concentration of the heavy rare earth elements in the shell part covering the core part. This makes it possible to increase coercive force and suppress the lowering of the maximum energy product, as compared with the two-alloy method. Furthermore, the amount of expensive heavy rare earth elements used can be suppressed.

In addition, Patent Document 3 discloses a technique including main phase particles, in which a concentration of the heavy rare earth elements in the core part is higher than the same in the shell part, to improve the coercive force as compared with the conventional R-T-B based sintered magnet.

Patent Document 1: JP-S59-46008A

Patent Document 2: International Publication No. 2006/043348

Patent Document 3: JP-2016-154219A

SUMMARY OF THE INVENTION

However, at present, further improvement of coercive force and cost reduction are required.

One of the objects of the present invention is to improve magnetic properties and to obtain a low-cost R-T-B based sintered magnet.

To achieve the object, the present invention discloses the following.

An R-T-B based sintered magnet including a plural number of main phase particles having an $R_2T_{14}B$ type crystal structure, in which R is at least one rare earth element, T is at least one transition metal element essentially including Fe or Fe and Co, and B is boron, the R-T-B based sintered magnet includes a magnet surface layer part and a magnet central part existing inside the magnet surface layer part, and a crystal orientation degree of the main phase particle in the magnet surface layer part having a magnetic pole surface is lower than the crystal orientation degree of the main phase particle in the magnet central part.

By having the above properties, the R-T-B based sintered magnet of the invention improves its magnetic properties and becomes a low-cost magnet.

The R-T-B based sintered magnet according to the invention, in which

R is at least one rare earth element essentially including a heavy rare earth element RH, and at least one of the main phase particles included in the magnet surface layer part is a reverse core-shell main phase particle including a core part and a shell part, in which $C_{RC}/C_{RS}>1.0$ is satisfied when a total RH concentration (at %) in the core part is defined as $C_{RC}$ and a total RH concentration (at %) in the shell part is defined as $C_{RS}$.

The R-T-B based sintered magnet of the invention in which the core part includes the low RH crystal phase, and the low RH crystal phase includes the $R_2T_{14}B$ type crystal structure, in which an RH concentration in the low RH crystal phase is relatively lower than an RH concentration in the whole main phase particle.

The R-T-B based sintered magnet according to the invention, in which the core part further includes a nonmagnetic R-rich phase.

DESCRIPTION OF THE PREFERRED EMBODIMENTS

Figure 1:
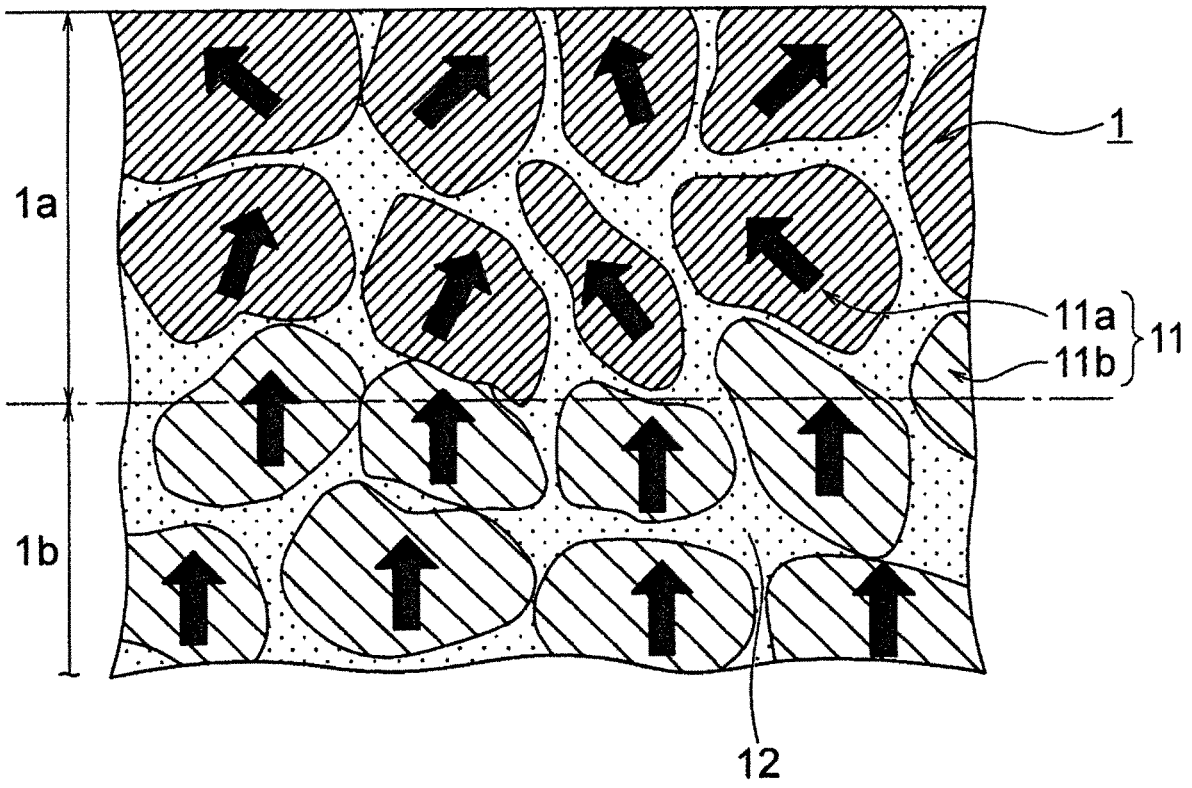
FIG. 1 is a schematic view of a cross section of R-T-B based sintered magnet according to an embodiment of the invention, which is perpendicular to a magnetic pole surface near the magnet surface layer part having the magnetic pole surface.

Hereinafter, the present invention is described based on the embodiments shown in the Figure.

<R-T-B Based Sintered Magnet>

The R-T-B based sintered magnet 1 according to the present embodiment includes main phase particles including $R_2T_{14}B$ type crystal structures. R is at least one rare earth element, T is at least one transition metal element essentially including Fe or Fe and Co, and B is boron. Heavy rare earth elements RH are preferably included as R. Zr may further be included. The rare earth element included as R refers to Sc, Y and lanthanoid elements belonging to the third group of a long period type periodic table. In addition, the heavy rare earth elements RH are Gd, Tb, Dy, Ho, Er, Tm, Yb and Lu.

An R content is not particularly limited, and it may be 25 mass % or more and 35 mass % or less, and preferably 28 mass % or more and 33 mass % or less. When the R content is 25 mass % or more, the $R_2T_{15}B$ crystal which becomes the main phase particle of the R-T-B based sintered magnet 1 tends to be formed sufficiently, deposition of such as α-Fe having soft magnetism tends to be suppressed, and the decrease in magnetic properties tends to be suppressed. When the R content is 35 mass % or less, the residual magnetic flux density Br of the R-T-B based sintered magnet 1 tends to be improved.

The B content in the R-T-B based sintered magnet according to the present embodiment may be 0.5 mass % or more and 1.5 mass % or less, preferably 0.8 mass % or more and 1.2 mass % or less, and more preferably 0.8 mass % or more and 1.0 mass % or less. When the B content is 0.5 mass % or more, the coercive force Hcj tends to be improved. Further, when the B content is 1.5 mass % or less, the residual magnetic flux density Br tends to be improved.

T may be Fe alone, or a part of Fe may be substituted with Co. The Fe content in the R-T-B based sintered magnet according to the present embodiment is a substantial balance when unavoidable impurities, O, C and N are removed from the R-T-B based sintered magnet. The Co content is preferably zero mass % or more and four mass % or less, more preferably 0.1 mass % or more and 2 mass % or less, and furthermore preferably 0.3 mass % or more and 1.5 mass % or less. The transition metal elements other than Fe or Fe and Co are not particularly limited, and examples thereof include such as Ti, V, Cr, Mn, Ni, Cu, Zr, Nb, Mo, Hf, Ta and W. In addition, a part of the transition metal element included as T may be substituted with an element such as Al, Ga, Si, Bi and Sn.

When the R-T-B based sintered magnet 1 includes one or two selected from Al and Cu, the content of one or two selected from Al and Cu is preferably 0.02 mass % or more and 0.60 mass % or less each. By respectively including 0.02 mass % or more and 0.60 mass % or less of one or two selected from Al and Cu, the coercive force and moisture resistance of the R-T-B based sintered magnet 1 tend to be improved, and the temperature properties tend to be improved. The Al content is preferably 0.03 mass % or more to 0.40 mass % or less, and more preferably 0.05 mass % or more to 0.25 mass % or less. Further, the Cu content is preferably more than zero mass % and 0.30 mass % or less, more preferably more than zero mass % and 0.20 mass % or less, and further preferably 0.03 mass % or more and 0.15 mass % or less.

The R-T-B based sintered magnet 1 may further include Zr. The Zr content may be more than zero mass % and 0.25 mass % or less. By including Zr within the above range, abnormal growth of the main phase particles can be suppressed in producing process of the sintered magnet, mainly in the sintering process. Therefore, the structure of the obtained sintered body (R-T-B based sintered magnet 1) becomes uniform and fine structure, and the magnetic properties of the obtained sintered body tends to be improved. To obtain the above effect more sufficiently, the Zr content may be 0.03 mass % or more and 0.25 mass % or less.

Further, the C content in the R-T-B based sintered magnet 1 is preferably 0.05 mass % or more and 0.30 mass % or less. By setting the C content to 0.05 mass % or more, the coercive force tends to be improved. By setting the C content to 0.30 mass % or less, a squareness ratio (Hk/Hcj) tends to be sufficiently high. Hk is the magnetic field strength when the magnetization in the second quadrant of the magnetic hysteresis loop (4πI-H curve) is 90% of the residual magnetic flux density (Br). The squareness ratio is a parameter indicating the ease of demagnetization due to the action of an external magnetic field and the temperature rise. When the squareness ratio is small, the demagnetization due to the action of the external magnetic field and the temperature increase becomes large. In addition, the strength of the magnetic field required for magnetization increases. To obtain more preferred coercive force and squareness ratio, it is preferable to set the C content to 0.10 mass % or more and 0.25 mass % or less.

Further, the O content in the R-T-B based sintered magnet 1 is preferably 0.03 mass % or more and 0.40 mass % or less. By setting the O content to 0.03 mass % or more, corrosion resistance tends to be improved. When the O content is 0.40 mass % or less, a liquid phase tends to be sufficiently formed when sintering, and coercive force tends to be improved. To obtain more preferable corrosion resistance and coercive force, the O content may be 0.05 mass % or more and 0.30 mass % or less, and may be 0.05 mass % or more and 0.25 mass % or less.

Further, the N content in the R-T-B based sintered magnet 1 is preferably zero mass % or more and 0.15 mass % or less. When the N content is 0.15 mass % or less, the coercive force tends to be sufficiently improved.

The R-T-B based sintered magnet 1 may include inevitable impurities such as Mn, Ca, Ni, Cl, S, and F in an amount of approximately 0.001 mass % or more and 0.5 mass % or less.

As a method of measuring the amounts of oxygen, carbon, and nitrogen in the R-T-B based sintered magnet, conventionally well-known methods can be used. The oxygen amount is measured by such as an inert gas fusion-non dispersive infrared absorption method, and the carbon amount is measured by such as an oxygen stream combustion-infrared absorption method, and the nitrogen amount is measured by such as an inert gas fusion-thermal conductivity method.

The grain diameter of the main phase particle including the $R_2T_{14}B$ type crystal structures is not particularly limited, but it is usually one μm or more and 10 μm or less.

The type of R is not particularly limited, but preferably includes Nd and Pr. Furthermore, the type of the heavy rare earth elements RH is also not particularly limited, but preferably include either one or both of Dy and Tb.

As shown in FIG. 1, in the R-T-B based sintered magnet 1 of the present embodiment, directions of the crystal orientation of the main phase particles 11 (low crystal oriented main phase particles 11*a*) in the magnet surface layer part 1*a* are not fixed, which are different from the same of the main phase particles 11 (high crystal oriented main phase particles 11*b*) in the magnet central part 1*b*. That is, in the R-T-B based sintered magnet 1 of the present embodiment, the crystal orientation degree of the main phase particle 11 in the magnet surface layer part 1*a* is lower than the same in the magnet central part 1*b*.

Here, it is considered that the coercive force becomes higher and the magnetization becomes lower, as the crystal orientation degree becomes low. The cause is considered as follows.

First, magnetization direction of the R-T-B based sintered magnet is set to 0°, and the angle of the c-axis direction of the main phase particle 11 including $R_2T_{14}B$ type crystal structures with respect to the magnetization direction is set to θ (°). Also, saturation magnetization of the main phase particle 11 is set to Js. When the external magnetic field is applied from the direction of 0°, the saturation magnetization component of the main phase particle 11 in the magnetic field direction is Js×cos θ. Here, as the degree of crystal orientation decreases, θ increases and Js×cos θ decreases. Therefore, even if the main phase particle 11 undergoes magnetization reversal, the influence on the magnetization reversal of a main phase particle 11 next to the main phase particle 11 is reduced. That is, by decreasing the degree of crystal orientation, it is considered that the coercive force is increased and the magnetization (residual magnetic flux density) is lowered.

Here, the present inventors have found that the coercive force of the entire R-T-B based sintered magnet is greatly affected by the coercive force of a part close to the magnet surface of the R-T-B based sintered magnet. On the other hand, the present inventors have found that the magnetization (residual magnetic flux density) of the entire R-T-B based sintered magnet is not greatly influenced only by the magnetization (residual magnetic flux density) near the magnet surface. Furthermore, the present inventors have found that the coercive force of the entire R-T-B based sintered magnet is greatly affected by the coercive force of a part near the magnet surface (magnetic pole surface) perpendicular to an axis of easy magnetization among the surfaces present in the R-T-B based sintered magnet. The term "magnetic pole surface" refers to the magnet surface through which the main magnetic force lines generated by the magnet pass.

According to the R-T-B based sintered magnet 1 of the embodiment, the coercive force of the magnet surface layer part 1*a* increases, as the degree of crystal orientation of the main phase particle 11 in the magnet surface layer part 1*a* having the magnetic pole surface decreases. And according to the R-T-B based sintered magnet 1 of the embodiment, it is possible to obtain high magnetic properties by making the crystal orientation degree of the main phase particles 11 (the low crystal oriented main phase particles 11*a*) in the magnet surface layer part 1*a* lower than the crystal orientation degree of the main phase particles 11 (the high crystal oriented main phase particles 11*b*) in the magnet central part 1*b*. In the present embodiment, the magnet surface layer part refers to a region of 5 μm or more and 150 μm or less from the magnet surface toward the inside of the magnet. The magnet central part refers to a part inside the magnet surface layer part. It is to be noted that the plane perpendicular to the direction in which the magnetic field is applied during molding is sometimes referred to as a C surface in the present technical field. Further, in the R-T-B based sintered magnet 1 according to the present embodiment, the C surface coincides with the magnetic pole surface, however, the C surface and the magnetic pole surface may not coincide.

According to the R-T-B based sintered magnet 1 of the present embodiment, at least one of the main phase particles 11 included in the magnet surface layer part 1*a* may be the reverse core-shell main phase particle. The reverse core-shell main phase particle includes the core part and the shell part. In addition, the shell part covers the core part. The core part and the shell part are made from the $R_2T_{14}B$ crystal phase, but their compositions are different from each other. Specifically, the RH concentration is different between the core part and the shell part. Further, it can be confirmed that the main phase particles 11 have a core-shell structure by observing with SEM at a magnification of 1,000 or more to 10,000 or less times.

Specifically, the section obtained by cutting the R-T-B based sintered magnet 1 of the present embodiment is mirror polished and then a backscattered electron image is taken by SEM. It is possible to discriminate from the composition contrast generated in the backscattered electron image whether each main phase particle is the core-shell main phase particle or the reverse core-shell main phase particle. Generally, the composition contrast becomes brighter (whiter) as the average atomic number of the observation target increases. In addition, the heavy rare earth elements RH has a larger atomic number as compared with other elements included in the R-T-B based sintered magnet. Therefore, in the region where the concentration of heavy rare earth elements RH is relatively high, the average atomic number becomes larger as compared with the region where the concentration of heavy rare earth elements RH is relatively low. In the backscattered electron image, a region with a high RH concentration inside the main phase particle is brighter (whiter) than a region with a low RH concentration. From the above, it can be determined whether each main phase particle is the core-shell main phase particle or the reverse core-shell main phase particle depending on the position of the bright part inside the main phase particle.

Here, the reverse core-shell main phase particles are the main phase particles including the $R_2T_{14}B$ type crystal structures. The reverse core-shell main phase particles satisfy $C_{RC}/C_{RS}>1.0$, when a total RH concentration (at %) in the core part is $C_{RC}$ and a total RH concentration (at %) in the shell part is $C_{RS}$.

That is, the reverse core-shell main phase particles are the main phase particles in which the total RH concentration in the core part is higher than that in the shell part, contrary to the generally known core-shell main phase particles.

There is no particular limitation on a measurement place of $C_{RC}$ and $C_{RS}$. For example, it can be as follows.

First, the reverse core-shell main phase particles for measuring the concentration is observed with transmission electron microscope (TEM), and a diameter having a maximum length is specified. Next, two intersection points of the diameter and the grain boundary are specified. Then, the total RH concentration in a region of 20 nm×20 nm centered on a midpoint of the two intersection points can be measured, and defined as the total RH concentration $C_{RC}$ in the core part.

Next, one of the two intersection points is selected. Then, the total RH concentration in a region of 20 nm×20 nm centered at the point, penetrating the reverse core-shell main phase particle side and 20 nm apart from the intersection point along the diameter having the maximum length can be measured, and defined as the total RH concentration $C_{RS}$ in the shell part.

The total RH concentration with respect to the total R concentration in the core part of the reverse core-shell main phase particles is not particularly limited, but is generally about 30% or more and 80% or less in an atomic ratio. The total RH concentration with respect to the total R concentration in the shell part of the reverse core-shell main phase particles is not particularly limited, but is generally about 10% or more and 30% or less in the atomic ratio.

In the reverse core-shell main phase particle, the shell part covers the entire surface of the core part, but it is not necessary for the shell part to cover the entire surface of the core part. It is sufficient that the shell part covers 60% or more of the surface of the core part. The core part and the shell part can be distinguished by SEM.

The R-T-B based sintered magnet 1 according to the present embodiment includes the reverse core-shell main phase particles. Thus, even when the usage amount of the heavy rare earth elements RH is reduced, the magnet becomes a permanent magnet having high residual magnetic flux density and coercive force. The mechanism by which the above effect is obtained by including the reverse core-shell main phase particle is the mechanism shown below.

According to the reverse core-shell main phase particle, the core part includes more RH as compared with the shell part, thereby the anisotropic magnetic field in the core part is increased. Therefore, it is considered that the anisotropic magnetic field changes at the interface between the core part and the shell part of the reverse core-shell main phase particle. It is considered that the pinning force increases due to the change of the anisotropic magnetic field within the reverse core-shell main phase particle. Therefore, it is considered that the R-T-B based sintered magnet 1 including the reverse core-shell main phase particles improves the coercive force.

In the R-T-B based sintered magnet 1 of the present embodiment, the existence ratio of the reverse core-shell main phase particles to all the main phase particles is preferably higher in the magnet surface layer part 1*a* than in the magnet central part 1*b*.

The reverse core-shell main phase particle includes more amount of the heavy rare earth element RH in the core part than in the shell part. Therefore, the residual magnetic flux density and the saturation magnetization of the reverse core-shell main phase particles are low. Since the reverse core-shell main phase particles have low saturation magnetization, even if a certain reverse core-shell main phase particle is magnetized, its influence on the magnetization reversal of the main phase particle adjacent to the reverse core-shell main phase particle is small. That is, since the reverse core-shell main phase particles are mainly present in the magnet surface layer part 1*a* of the R-T-B based sintered magnet 1, the transfer of reverse magnetic domains generated from the magnet surface is suppressed. Therefore, since the reverse core-shell main phase particles exist more in the magnet surface layer part 1*a*, the coercive force of the R-T-B based sintered magnet 1 is further improved.

$C_{RC}/C_{RS}>1.5$ is preferable, and $C_{RC}/C_{RS}>3.0$ is more preferable in the reverse core-shell main phase particle included in the R-T-B based sintered magnet 1 of the present embodiment. In the reverse core-shell main phase particle, it is preferable that the heavy rare earth elements RH exist more in the core part than in the shell part to obtain greater above-mentioned effects and further improvement in the coercive force.

Figure 2:
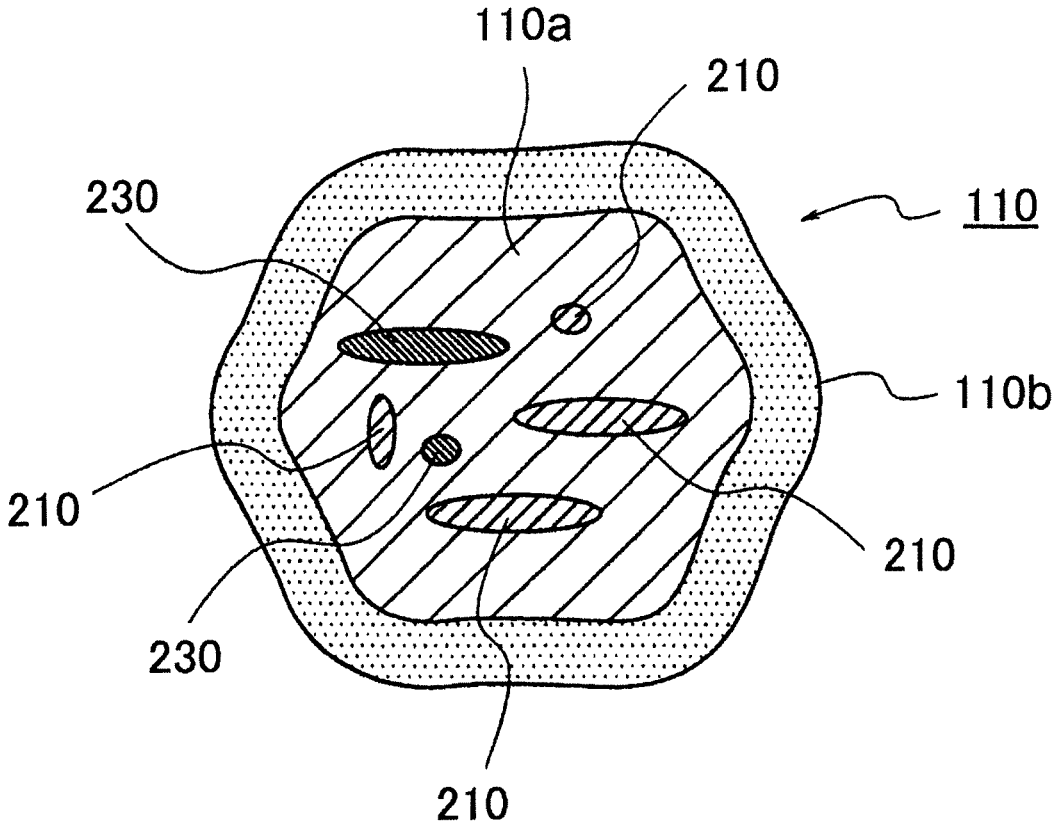
FIG. 2 is a schematic view of a nonuniform reverse core-shell main phase particle of an embodiment of the present invention.

As shown in FIG. 2, the R-T-B based sintered magnet according to this embodiment includes a core part 110*a* and a shell part 110*b*. The R-T-B based sintered magnet may further include nonuniform reverse core-shell main phase particles 110 including a low RH crystal phase 210 inside the particles 110. As shown in FIG. 2, a plurality of low RH crystal phases 210 may be present in one nonuniform reverse core-shell main phase particle 110. Although the size of one low RH crystal phase 210 is not particularly limited, it is preferably 5% or more and 30% or less in terms of the sectional area ratio with respect to the nonuniform reverse core-shell main phase particle 110.

Incidentally, the inclusion of the low RH crystal phase 210 in the main phase particles can be confirmed using SEM and TEM.

The low RH crystal phase 210 is an $R_2T_{14}B$ crystal phase having a lower concentration of the heavy rare earth elements RH relative to the main phase existing around the low RH crystal phase 210. More specifically, it is $R_2T_{14}B$ crystal phase which satisfies $N1-L1\geq0.5$ when the total RH concentration (at %)/the total RL concentration (at %) in the low RH crystal phase 210 is represented by L1 and the total RH concentration (at %)/the total RL concentration (at %) in the main phase existing around the low RH crystal phase is represented by N1.

The presence of the low RH crystal phase 210 can be confirmed by SEM, SEM-EDS, TEM and TEM-EDS. Specifically, it can be visually confirmed by SEM that some different phases exist in the main phase particles. It can be confirmed by TEM that the different phases are the $R_2T_{14}B$ crystal phases. Furthermore, N1−L1 of the different phase can be specified by TEM-EDS.

Further, in the R-T-B based sintered magnet 1 according to the present embodiment, it is preferable that the content ratio of the nonuniform reverse core-shell main phase particles 110 in the main phase particles 11 is larger in the magnet surface layer part 1*a* than in the magnet central part 1*b*.

Specifically, it is preferable to satisfy $r_s-r_c\geq20\%$ when $r_s$ (%) is the existence ratio of the main phase particles including the low RH crystal phase 210 in the magnet surface layer part 1*a*, $r_c$ (%) is the existence ratio of the main phase particles including the low RH crystal phase in the magnet central part 1*b*.

The R-T-B based sintered magnet according to the present embodiment has a large number of nonuniform reverse core-shell main phase particles 110, particularly in the magnet surface layer part 1*a*. Thus, the residual magnetic flux density and the coercive force are improved.

The nonuniform reverse core-shell main phase particles 110 are considered to have a low RH crystal phase 210, so that a rapid change in the anisotropic magnetic field occurs within the nonuniform reverse core-shell main phase particle 110. This rapid change in the anisotropic magnetic field increases the pinning force. As a result, the coercive force is considered to improve. Furthermore, since such a large number of nonuniform reverse core-shell main phase particles 110 are present in the magnet surface layer part 1*a*, the transfer of the reverse magnetic domains generated from the magnet surface is suppressed. Therefore, it is possible to improve the coercive force of the R-T-B based sintered magnet 1 with the use of a small amount of heavy rare earth element RH. Furthermore, since the amount of heavy rare earth element RH used can be reduced, the residual magnetic flux density can also be improved. In addition, since the plurality of low RH crystal phases 210 are present in one nonuniform reverse core-shell main phase particle 110, movement of domain walls from any direction can be suppressed. Further, since the low RH crystal phase 210 is the $R_2T_{14}B$ type crystal phase similar to the surrounding main phases, matching of the crystals can be achieved. Therefore, the occurrence of strain is suppressed, and the coercive force improving effect is increased.

Preferably, the low RH crystal phase 210 does not substantially include the heavy rare earth element RH. "Not substantially include" means that the atomic ratio of RH/R in the low RH crystal phase 210 is 0.03 or less.

When the low RH crystal phase 210 does not substantially contain the heavy rare earth RH, the above effects obtained by including the low RH crystal phase 210 is further increased.

In addition, as shown in FIG. 2, it is preferable that the nonuniform reverse core-shell main phase particles 110 further include nonmagnetic R-rich phases 230 therein. In addition, a plurality of nonmagnetic R-rich phases 230 may be present in one nonuniform reverse core-shell main phase particles 110. Although the size of one nonmagnetic R-rich phases 230 is not particularly limited, it is preferably 5% or more and 15% or less in terms of the sectional area ratio with respect to the nonuniform reverse core-shell main phase particles 110.

Specifically, the nonmagnetic R-rich phases 230 refer to the R-rich phases in which the R content is 70 atomic % or more and 100 atomic % or less. Further, the nonmagnetic R-rich phases 230 are not the $R_2T_{14}B$ type crystal phase.

The presence of the nonmagnetic R-rich phase 230 in the main phase particles can be confirmed by SEM, SEM-EDS, TEM and TEM-EDS. Specifically, it can be visually confirmed by the SEM image that some different phase exists inside the main phase particles, and the R content in the different phase can be specified by TEM-EDS.

By including the nonmagnetic R-rich phase 230 inside the nonuniform main phase particles 110, it is possible to generate a large anisotropic magnetic field gap in plural places within the particle. Therefore, it is possible to suppress the transfer of the motion of the domain wall from any direction, and to improve the coercive force of the R-T-B based sintered magnet.

In addition, when the R-T-B based sintered magnet 1 according to the present embodiment includes the nonuniform main phase particles 110 including the low RH crystal phase 210 and the nonmagnetic R-rich phase 230, it is preferable that the magnet to include more nonuniform main phase particles 110 in the magnet surface layer part 1*a* than in the magnet central part 1*b*. Specifically, it is preferable to satisfy $r_{sh}-r_{ch}>20\%$ when $r_{sh}$ (%) is the existence ratio of the main phase particles including the low RH crystal phase 210 and the nonmagnetic R-rich phase 230 in the magnet surface layer part 1*a* and $r_{ch}$ (%) is the existence ratio of the main phase particles including the same in the magnet central part.

Further, as shown in FIG. 2, it is preferable that the core part 110*a* includes the low RH crystal phases 210 and the nonmagnetic R-rich phases 230 in the nonuniform reverse core-shell main phase particles. The effect of improving the coercive force becomes greater when the core part 110*a* includes the low RH crystal phase 210 and the nonmagnetic R-rich phase 230.

<Producing Method of R-T-B Based Sintered Magnet>

Next, a producing method of the R-T-B based sintered magnet according to the present embodiment will be described.

Hereinafter, the R-T-B based sintered magnet, produced by a powder metallurgy method in which the heavy rare earth elements are grain boundary diffused, will be described as an example, however, the producing method of the R-T-B based sintered magnet according to the present embodiment is not particularly limited, and other methods can also be used.

The producing method of the R-T-B based sintered magnet according to the present embodiment includes a pressing step of pressing a raw material powder to obtain a green compact, a sintering step of sintering the green compact to obtain a sintered body, and an aging step of maintaining the sintered body at a temperature lower than the sintering temperature for a certain period of time.

Hereinafter, the producing method of the R-T-B based sintered magnet will be described in detail, however as a matter not specified, known methods can be used.

[Preparing Step of Raw Material Powder]

The raw material powder can be prepared by a known method. In the present embodiment, the R-T-B based sintered magnet is produced by the single alloy method using one of the raw material alloy mainly including the $R_2T_{14}B$ phase, however, it may be produced by the two-alloy method using two of raw material alloys. Here, the composition of the raw material alloy is controlled to be the composition of the finally obtained R-T-B based sintered magnet.

First, a raw material metal corresponding to the composition of the raw material alloy of the present embodiment is prepared, and a raw material alloy of this embodiment is produced from the raw material metal. There is no particular limitation on the producing method of the raw material alloy. For example, the raw material alloy can be produced by a strip casting method.

After producing the raw material alloy, the produced raw material alloy is pulverized (a pulverization step). The pulverization step may be carried out in two stages or in one stage. The pulverization method is not particularly limited. For example, it is carried out by a method using various pulverizers. For example, the pulverization step can be carried out in two stages, a coarse pulverization step and a fine pulverization step, and in the coarse pulverization step, such as a hydrogen pulverization can be carried out. Specifically, it is possible to carry out dehydrogenation at 400° C. or more and 650° C. or less for 0.5 hour or more to two hours or less in an Ar gas atmosphere, after the raw material alloy stores hydrogen at room temperature. Further, the fine pulverization step can be carried out by using a jet mill, a wet attritor, etc., after adding such as oleic acid amide, zinc stearate, etc. to the powder after the coarse pulverization. There is no particular limitation on the grain diameter of the fine pulverized powder (the raw material powder) to be obtained. For example, it can be finely pulverized so as to be finely pulverized powder (raw material powder) having a grain diameter (D50) of 1 μm or more and 10 μm or less.

[Pressing Process]

In the pressing step, the finely pulverized powder (the raw material powder) obtained by the pulverization step is pressed into a predetermined shape. The pressing method is not particularly limited, but in the present embodiment, the finely pulverized powder (the raw material powder) is filled in a metal mold and pressurized in a magnetic field.

It is preferable to perform pressurization when pressing at 30 MPa or more and 300 MPa or less. The applied magnetic field is preferably 950 kA/m or more and 1600 kA/m or less. The shape of the green compact obtained by pressing the finely pulverized powder (the raw material powder) is not particularly limited, and it can have an arbitrary shape depending on the shape of a desired R-T-B based sintered magnet, such as a rectangular parallelepiped, a flat plate, a column, etc.

[Sintering Step]

Sintering step is a step of sintering the green compact in a vacuum or an inert gas atmosphere to obtain a sintered body. The sintering temperature needs to be adjusted according to various conditions such as composition, pulverization method, difference in grain size and grain size distribution, etc. However, it is sintered by firing at the sintering temperature of 1000° C. or more and 1200° C. or less in a vacuum or in the presence of an inert gas for one hour or more and 10 hours or less. As a result, a high dense sintered body (sintered magnet) can be obtained.

[Aging Step]

The aging step is performed by heating the sintered body (a sintered magnet) after the sintering step at a temperature lower than the firing temperature. There is no particular limitation on temperature and time of the aging, but it can be carried out, for example, at 450° C. or more and 900° C. or less for 0.2 hour or more and three hours or less. This aging step may be omitted.

Further, the aging step may be carried out in one stage or in two stages. In the case of carrying out in the two stages, for example, the first stage can be set to 700° C. or more and 900° C. or less for 0.2 hour or more and three hours or less, and the second stage can be set to 450° C. or more and 700° C. or less for 0.2 hour or more and three hours or less. Further, the first stage and the second stage may be carried out continuously, or the second stage may be carried out after once cooling to near room temperature and reheating after the first stage.

[Degree of Crystal Orientation Lowering Step]

There is no particular limitation on a method of lowering the degree of crystal orientation of the main phase particles according to the present embodiment. For example, degree of crystal orientation can be lowered through the following decomposition step, grain boundary diffusion step and recombinding step.

[Decomposition Step]

The decomposition step is a step of decomposing and making finely structured main phase particles including the $R_2T_{14}B$ type crystal structure mainly existing in the magnet surface layer part. The conditions of the decomposition step are not particularly limited as long as the main phase particles, including the $R_2T_{14}B$ type crystal structure and mainly existing in the magnet surface layer part, are decomposed and are made to have finer structures.

For example, by heating in an inert atmosphere including $H_2$ gas, CO gas or $N_2$ gas, at about 600° C. or more and 900° C. or less, for approximately 5 minutes or more to 60 minutes or less, $H_2$, CO or $N_2$ is stored in the main phase particles mainly existing in the magnet surface layer part and the main phase particles are made disproportionate having finer structure.

By controlling the concentration of $H_2$ gas, CO gas or $N_2$ gas, heating temperature and/or heating time, the thickness of the region where the main phase particles are finely structured can be controlled and distribution of the finally obtained the thickness of a low crystal orientation degree layer can be controlled.

It is also possible to make disproportionate and finely structured main phase particles existing in the magnet surface layer part by heating in an oxidizing atmosphere including an oxidizing gas at about 300° C. or more to 500° C. or less for about 20 minutes or more to 60 minutes or less.

[Diffusion Step]

In the present embodiment, the decomposition step is followed by a diffusion step in which the rare earth elements are further diffused. The diffusion can be carried out by adhering such as compounds (hereinafter, it is sometimes simply referred to as rare earth compounds) including the rare earth elements to a surface of the sintered body subjected to the decomposition step, and then subjecting it to heat treatment. The adhering method of the compounds including the rare earth elements is not particularly limited, and it can be adhered by such as applying slurry including the rare earth elements. The kind of the rare earth element to be diffused is arbitrary, but heavy rare earth elements are preferable. When diffusing the heavy rare earth elements, the above $C_{RC}/C_{RS}$ can be controlled by controlling the coating amount of the slurry and the concentration of the heavy rare earth elements included in the slurry.

However, the adhering method of the rare earth elements is not particularly limited. For example, there are methods using vapor deposition, sputtering, electrodeposition, spray coating, brush coating, jet dispenser, nozzle, screen printing, squeegee printing, sheet method, etc.

When applying slurry, the rare earth compound is preferably in the form of grains. Further, the average grain diameter is preferably 100 nm or more and 50 μm or less, and more preferably 1 μm or more and 10 μm or less.

As the solvent used for the slurry, it is preferable to use a solvent capable of uniformly dispersing the rare earth compound without dissolving the compound. For example, alcohols, aldehydes, ketones, etc. can be exemplified, and among them, ethanol is preferable.

The rare earth compound content in the slurry is not particularly limited. For example, it may be 50 wt % or more and 90 wt % or less. If necessary, the slurry may further include components other than the rare earth compound. For example, dispersants for preventing aggregation of particles of the rare earth compound can be mentioned.

By performing the diffusion step on the sintered body subjected to the decomposition step, the rare earth elements diffuse inside the finely structured particles mainly existing in the magnet surface layer part, in addition to the grain boundaries of the entire sintered body.

The conditions of the diffusion step is not particularly limited, however it is preferable to perform at 650° C. or more and 1000° C. or less for one hour or more and 24 hours or less. By setting temperature and time within the above range, it becomes easy to increase the ratio of the rare earth elements incorporated in the finely structured particles. In the diffusion step, the respective components included in the above $H_2$ gas, CO gas or $N_2$ gas, or the oxidizing gas are released.

[Recombinding Step]

Through the recombining step after the diffusion step, the finely structured particles are recombined and $R_2T_{14}B$ crystals are formed. However, even when recombined, the degree of crystal orientation does not return to the value before the decomposition, and the degree decreases. The recombining step is carried out by such as rapidly cooling at a rate of 50° C./min or more and 500° C./min or less. The cooling rate is not particularly limited, however, it tends to be fine crystals including many amorphous if the cooling rate is excessively fast, while, a boundary surface between the core part 110*a* and the shell part 110*b* of the reverse core-shell main phase particle 110 tend to be unclear if the cooling rate is excessively slow.

As mentioned, it is important that the production method of the R-T-B based sintered magnet of the present embodiment is carried out at least in the order of the decomposition step of decomposing the main phase particles included in the magnet surface layer part to have fine structure, the grain boundary diffusion step of diffusing the rare earth elements in the finely structured particles, and the recombining step of recombining the finely structured particles. This makes it possible to decrease the degree of crystal orientation in the magnet surface layer part of the R-T-B based sintered magnet. The methods and conditions of the above decomposition step, the grain boundary diffusion step, and the recombining step are merely examples. The decomposition step is sufficient as long as it is a step of decomposing and finely structured main phase particles in the magnet surface layer part. The grain boundary diffusion step is sufficient as long as it is a step of diffusing the rare earth elements in the finely structured particle. It is also possible to generate reverse core-shell particles in the magnet surface layer part through the above decomposition step, grain boundary diffusion step and recombining step.

[Re-Aging Step]

Re-aging step is performed by heating the sintered magnet after the recombining step at a temperature lower than the maximum temperature of the diffusion step. Temperature and time of the re-aging is not particularly limited; however, it can be carried out such as at 450° C. or more and 800° C. or less for 0.2 hour or more and three hours or less.

The R-T-B based sintered magnet obtained by the above steps may be subjected to a surface treatment such as plating, resin coating, oxidation treatment, chemical conversion treatment, etc. As a result, the corrosion resistance can be further improved.

Further, a magnet obtained by cutting and dividing the R-T-B based sintered magnet of the present embodiment can be used.

Specifically, the R-T-B based sintered magnet of the present embodiment is suitably used for such as a motor, a compressor, a magnetic sensor, a speaker, etc.

In addition, the R-T-B based sintered magnet of the present embodiment may be used singly, or two or more R-T-B based sintered magnets connected as necessary may be used. The connecting method is not particularly limited. For example, there are methods such as mechanically connected, connected by a resin mold, etc.

By connecting two or more R-T-B based sintered magnets, a large R-T-B based sintered magnet can be easily produced. Magnets in which two or more R-T-B based sintered magnets are connected are preferably used for applications requiring particularly large R-T-B based sintered magnets, such as IPM motors, wind power generators, large motors, etc.

EXAMPLE

Hereinafter, the invention will be described in detail referring to examples; however, the invention is not limited thereto.

(Production Step of Sintered Magnet)

Nd, electrolytic iron, low carbon ferroboron alloy were prepared as raw material metals. Furthermore, Al, Cu, Co and Zr were prepared in a form of a pure metal or an alloy with Fe.

An alloy for the sintered body (a raw material alloy) was produced from the raw material metal by the strip casting method so that the composition of the sintered magnet becomes the composition shown in the column of alloy A in the latter described Table 1. The content (wt %) of each element shown in Table 1 is a value when the total content of Nd, B, Al, Cu, Co, Zr and Fe is taken as 100 wt %. In addition, the alloy thickness of the material alloy was set to 0.2 mm or more to 0.6 mm or less.

Subsequently, hydrogen was stored to the raw material alloy by hydrogen gas flow at room temperature for one hour. Then, the atmosphere was changed to Ar gas, dehydrogenation was carried out at 450° C. for one hour, and the raw material alloy was hydrogen pulverized. Further, after cooling, a powder having a grain size of 400 μm or less was obtained by using a sieve.

Then, oleic acid amide in an amount of 0.1 wt % was added as a pulverization aid to the powder of the raw material alloy after hydrogen pulverization, and mixed thereof.

Next, using a collision plate type jet mill device, a fine pulverization was carried out in a nitrogen stream to obtain a fine powder (a raw material powder) each having an average grain diameter of approximately 4 μm. The average grain diameter is the average grain diameter D50 measured by a laser diffraction type grain diameter distribution meter.

According to the elements not listed in Table 1, H, Si, Ca, La, Ce, Cr, etc. may be detected in some cases. Si is mainly mixed from a ferroboron raw material and crucible at melting of alloy. Ca, La and Ce are mixed from the rare earth raw material. Also, there is a possibility that Cr is mixed from an electrolytic iron.

The obtained fine powder was pressed in a magnetic field to produce a green compact. The applied magnetic field at this time was a static magnetic field of 1200 kA/m. The pressure applied when pressing was 120 MPa. In addition, the magnetic field application direction and the pressing direction were orthogonalized. When density of the green compact was measured at this point, the densities of all the green compacts were within the range of 4.10 $Mg/m^3$ or more and 4.25 $Mg/m^3$ or less.

Next, the green compact was sintered to obtain a sintered magnet. The sintering conditions were maintained at 1060° C. for four hours. The sintering atmosphere was vacuum. The sintered density at the time was in the range of 7.50 $Mg/m^3$ or more and 7.55 $Mg/m^3$ or less. Thereafter, a first aging was carried out for one hour at a first aging temperature T1=900° C. in an Ar atmosphere under an atmospheric pressure, and further a second aging was carried out for one hour at a second aging temperature T2=500° C.

The composition of the obtained sintered magnet was evaluated by fluorescent X-ray analysis. B content was evaluated by ICP. It was confirmed that the composition of the sintered magnet in each sample is as shown in Table 2. Then, the obtained sintered magnets were subjected to the processes of Examples 1 to 14 and Comparative Examples 1 to 4 described hereinafter.

Example 1

The sintered magnet obtained by the above process was processed into a rectangular parallelepiped having a width of 20 mm, a length of 20 mm, and a thickness in the orientation direction of 5 mm, and was then immersed in an atmosphere gas of 5 vol % of hydrogen and 95 vol % of Ar, and held at 750° C. for 10 minutes to disproportionate and finely structured main phase particles mainly existing in the magnet surface layer part. The magnetic pole surface (C surface) of the sintered magnet is 20 mm×20 mm.

Next, a slurry in which $TbH_2$ particles (average grain diameter D50=5 μm) are dispersed in ethanol was applied to the entire surface of the sintered magnet so that the weight of Tb with respect to that of the sintered magnet became 0.5 wt %. Tb was then adhered to the sintered magnet. After coating the slurry, the diffusion treatment was carried out at 770° C. for five hours in Ar flow at atmospheric pressure, followed by the heat treatment at 950° C. for five hours. Tb was grain boundary diffused. Tb was then diffused even in the finely structured particles.

After the heat treatment, it was rapidly cooled at a cooling rate of 200° C./min., and the finely structured particles were recombined.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Example 2

The sintered magnet obtained by the above steps was held at 700° C. for 10 minutes in an atmospheric gas having 8 vol % of CO and 92 vol % of Ar to disproportionate and finely structured main phase particles mainly present in the magnet surface layer part.

Next, a slurry in which $TbH_2$ particles (average grain diameter D50=5 μm) are dispersed in ethanol was applied to the entire surface of the sintered magnet so that the weight ratio of Tb with respect to that of the sintered magnet became 0.5 wt %. Tb was then adhered to the sintered magnet. After coating the slurry, the diffusion treatment was carried out at 770° C. for five hours in Ar flow at atmospheric pressure, followed by the heat treatment at 950° C. for five hours. Tb was then diffused even in the finely structured particles.

After the heat treatment, it was rapidly cooled at a cooling rate of 200° C./min., and the finely structured particles were recombined.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Example 3

The sintered magnet obtained by the above steps was held at 650° C. for 30 minutes in an atmospheric gas having 8 vol % of $N_2$ and 92 vol % of Ar to disproportionate and finely structured main phase particles mainly present in the magnet surface layer part.

Next, a slurry in which $TbH_2$ particles (average grain diameter D50=5 μm) are dispersed in ethanol was applied to the entire surface of the sintered magnet so that the weight ratio of Tb with respect to that of the sintered magnet became 0.5 wt/o. Tb was then adhered to the sintered magnet. After coating the slurry, the heat treatment was carried out at 770° C. for five hours in Ar flow at atmospheric pressure, followed by the heat treatment at 950° C. for five hours. Tb was then diffused even in the finely structured particles.

After the heat treatment, it was rapidly cooled at a cooling rate of 200° C./min., and the finely structured particles were recombined.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Example 4

The sintered magnet obtained by the above steps was held at 400° C. for 30 minutes in an oxidizing atmosphere including a gas whose vapor partial pressure was adjusted to 200 hPa, to disproportionate and finely structured main phase particles mainly existing in the magnet surface layer part.

Next, a slurry in which $TbH_2$ particles (average grain diameter D50=5 μm) are dispersed in ethanol was applied to the entire surface of the sintered magnet so that the weight ratio of Tb with respect to that of the sintered magnet became 0.5 wt %. Tb was then adhered to the sintered magnet. After coating the slurry, the heat treatment was carried out at 770° C. for five hours in Ar flow at atmospheric pressure, followed by the heat treatment at 950° C. for five hours. Tb was then diffused even in the finely structured main phase particles.

After the heat treatment, it was rapidly cooled at a cooling rate of 200° C./min., and the finely structured main phase particles were recrystallized.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Example 5

The steps were carried out in the same manner as in Example 1 except that the $TbH_2$ particles (average grain diameter D50=5 μm) were replaced with the particles in which $TbH_2$ particles (average grain diameter D 50=5 μm) and $NdH_2$ particles (average grain diameter D50=5 μm) are mixed to be Tb:Nd=80:20 (atomic ratio). Tb and Nd were adhered making the weight of Tb with respect to the weight of the sintered magnet to 0.5 wt %.

Example 6

The steps were carried out in the same manner as in Example 1 except that the $TbH_2$ particles (average grain diameter D50=5 μm) were replaced with the particles in which $TbH_2$ particles (average grain diameter D 50=5 μm) and $NdH_2$ particles (average grain diameter D50=5 μm) are mixed to be Tb:Nd=70:30 (atomic ratio). Tb and Nd were adhered making the weight of Tb with respect to the weight of the sintered magnet to 0.5 wt %.

Example 7

The steps were carried out in the same manner as in Example 1 except that the holding time in an atmosphere gas having 5 vol % of hydrogen and 95 vol % of Ar was 20 minutes.

Example 8

The steps were carried out in the same manner as in Example 1 except that the holding time in an atmosphere gas having 5 vol % of hydrogen and 95 vol % of Ar was 30 minutes.

Example 9

The steps were carried out in the same manner as in Example 1 except that the cooling rate after the heat treatment was set to 50° C./min.

Example 10

The steps were carried out in the same manner as in Example 1 except that the cooling rate after the heat treatment was set to 500° C./min.

Example 11

The sintered magnet obtained by the above steps was held at 750° C. for 10 minutes in an $H_2$ gas to disproportionate and finely structured main phase particles mainly present in the magnet surface layer part.

Next, a slurry in which $TbH_2$ particles (average grain diameter D50=5 μm) are dispersed in ethanol was applied to the entire surface of the sintered magnet so that the weight ratio of Tb with respect to that of the sintered magnet became 0.5 wt %. Tb was then adhered to the sintered magnet. After coating the slurry, the diffusion treatment was carried out at 770° C. for five hours in Ar flow at atmospheric pressure, followed by the heat treatment at 820° C. for five hours. Tb was then diffused even in the finely structured main phase particles.

After the heat treatment, it was rapidly cooled at a cooling rate of 200° C./min., and the finely structured particles were recombined.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated by B-H tracer.

Example 12

The steps were carried out in the same manner as in Example 1 except that the $TbH_2$ particles (average grain diameter D50=5 μm) were replaced with $NdH_2$ particles (average grain diameter D50=5 μm). Nd was adhered making the weight of Nd with respect to the weight of the sintered magnet to 0.5 wt %.

Example 13

The steps were carried out in the same manner as in Example 1 except that slurry in which $TbH_2$ particles (average grain diameter D50=5 μm) are dispersed in ethanol was applied only to both magnetic pole surfaces of the sintered magnet (C surface). Thus, Tb was adhered making the weight ratio of Tb with respect to the weight of the sintered magnet to 0.5 wt %

Example 14

The steps were carried out in the same manner as in Example 1 except that the $TbH_2$ particles (average grain diameter D50=5 μm) were replaced with the particles in which $TbH_2$ particles (average grain diameter D50=5 μm) and $NdH_2$ particles (average grain diameter D50=5 μm) are mixed to be Tb:Nd=50:50 (atomic ratio). Tb and Nd were adhered making the weight of Tb with respect to the weight of the sintered magnet to 0.5 wt %.

Comparative Example 1

Next, a slurry in which $TbH_2$ particles (average grain diameter D50=5 μm) are dispersed in ethanol was applied to the entire surface of the sintered magnet obtained by the above-mentioned production step of sintered magnet. Thus, Tb was adhered by the weight ratio of Tb with respect to the weight of the sintered magnet to 0.5 wt %

The diffusion treatment was carried out at 770° C. for five hours in Ar flow at atmospheric pressure, followed by the heat treatment at 950° C. for five hours. Thus, Tb was grain boundary diffused. Then, after the heat treatment, it was rapidly cooled at a cooling rate of 200° C./min.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Comparative Example 2

In the production steps of the sintered magnet, the alloys for sintered bodies (raw material alloys) B and C were produced so as to have the composition shown in Table 1. The raw material alloys B and C shown in Table 1 were hydrogen-pulverized, and then mixed to have the weight ratio of 9:1. Then, fine pulverization, pressing, sintering and aging were carried out in the same manner as in Example 1 to obtain a sintered magnet having the composition shown in Table 2. It was confirmed that the composition of the sintered magnet was the same as that of the sintered magnets of Examples 1 to 4, 7 to 11, 13 and Comparative Examples 1 and 4 after the diffusion.

For the sintered magnet after the aging, the magnetic properties of residual magnetic flux density Br, coercive force Hcj and squareness ratio Hk/Hcj were evaluated with B-H tracer.

Comparative Example 3

The steps were carried out in the same manner as in Example 12 except that the main phase particles existing in the sintered magnet surface layer part were not disproportionated and finely structured.

Comparative Example 4

The steps were carried out in the same manner as in Example 1 except that slurry in which $TbH_2$ particles (average grain diameter D50=5 μm) are dispersed in ethanol was applied to four surfaces except both magnetic pole surfaces (C surface) of the sintered magnet. Thus, Tb was adhered making the weight ratio of Tb with respect to the weight of the sintered magnet to 0.5 wt %.

Table 3 shows whether the decomposition, grain boundary diffusion, and rapid cooling after the grain boundary diffusion were carried out for decomposing the main phase particles present in the surface layer part of each R-T-B based sintered magnet according to Examples 1 to 11 and 14, Comparative Examples 1 and 2. "Done" is given when each process was performed, and "Not Done" is given when each process was not performed. It also shows whether RH was adhered to both magnetic pole surfaces (C surface) of the sintered magnet and whether RH was adhered to the four surfaces except for the both magnetic pole surfaces (C surface) of the sintered magnet were carried out in each Examples and Comparative Examples. "Done" is given when RH is adhered to the both magnetic pole surfaces or to the four surfaces except for the both magnetic pole surfaces, and "Not Done" is given when RH is not adhered to each of the above surfaces.

Table 3 shows the evaluation results of the magnetic properties of residual magnetic flux density Br, coercive force Hcj and squareness ratio Hk/Hcj with respect to the R-T-B based sintered magnets of the respective Examples 1 to 11, 14 and Comparative Examples 1 and 2 by B-H tracer. The residual magnetic flux density Br of 1380 mT or more was defined preferable, and 1400 mT or more was defined further preferable. The coercive force Hcj was defined preferable when 1790 kA/m or more, and more preferable when 1830 kA/m or more. It was regarded preferable when the squareness ratio Hk/Hcj was 0.95 or more.

The crystal orientation degree of R-T-B based sintered magnet according to each Example and Comparative Example was measured by the following method.

First, the magnetic pole surfaces of the R-T-B based sintered magnet of respective examples and comparative examples were mirror polished. Thereafter, X-ray diffraction measurement was performed on the mirror polished surface, and the degree of orientation was calculated by Lotgering method based on the obtained diffraction peak. According to Lotgering method, based on the X-ray diffraction intensity I (001) of the component of (001) reflection and the X-ray diffraction intensity I (hk0) of the component of (hk0) reflection, the crystal orientation degree fc can be calculated by the following equation 1.

$$fc = \frac{\sum I(00l)}{\sum I(hk0)} \times 100 \quad \text{[Equation 1]}$$

When calculating the orientation degree by Lotgering method, only the orientation direction, that is, the component of (001) reflection among the diffraction peaks, was accumulated on the numerator. With respect to the component of the diffraction peak that slightly deviates from the alignment direction, it is judged as a component in the vertical direction of the alignment direction, that is, (hk0) reflection component. Thus, in the formula shown in the above Equation 1, it is excluded from the numerator and integrated on the denominator. Therefore, the orientation degree calculated relative to the actual orientation degree is a rather small value. To calculate the actual orientation degree, it is preferable to perform vector correction on the diffraction peak, but vector correction was not performed in this embodiment.

The crystal orientation degree on the magnetic pole surface was calculated by the above method. Further, the thickness of the low crystal orientation degree layer was measured by the following method.

The mirror polished surface was polished by every 10 μm from the magnetic pole surface, and X-ray diffraction measurement was performed on the every 10 μm mirror polished surface. And the crystal orientation degree was calculated by Lotgering method. The thickness of the part where the crystal orientation degree is decreased by 2% or more with respect to the crystal orientation degree in the magnet central part is defined as the thickness of the low crystal orientation degree layer. Note that the crystal orientation degree at the magnet central part refers to the degree of crystal orientation in the case where the crystal orientation degree is the highest among the crystal orientation degrees calculated every 10 μm. In addition, when the crystal orientation degree on the magnetic pole surface does not decrease by 2% or more with respect to the crystal orientation degree in the magnet central part, it is assumed that there is no low crystal orientation degree layer.

In addition, existence ratio of the reverse core-shell main phase particles in a region of 20 μm from the magnetic pole surface toward the inside of the magnet in the magnet surface layer part having the magnetic pole surface was measured. The measurement of the existence ratio of the reverse core-shell main phase particles in the magnet surface layer part having the magnetic pole surface was carried out with respect to 10 main phase particles randomly selected from the main phase particles in the part of 20 μm from the magnetic pole surface toward the inside of the magnet, using SEM and TEM-EDS. Also, the existence ratio of the reverse core-shell main phase particles in the magnet central part was measured. Measurement of the existence ratio of the reverse core-shell main phase particles in the magnet central part was carried out by using SEM and TEM-EDS for 10 main phase particles randomly selected from the main phase particles in the magnet central part. The results are shown in Table 4.

Further, with respect to the reverse core-shell main phase particles present in the magnet surface layer part having the magnetic pole surface, the total RH concentration $C_{RC}$ in the core part and the total RH concentration $C_{RS}$ in the shell part were measured by TEM-EDS. The ratio of particles having $C_{RC}/C_{RS}>1.5$ and the same having $C_{RC}/C_{RS}>3.0$ in each reverse core-shell main phase particles were calculated using TEM-EDS. The results are shown in Table 4.

According to the reverse core-shell main phase particles of Examples 1 to 11 and 14, the measurement points of the total RH concentration in the core part and the same in the shell part are as follows.

First, the reverse core-shell main phase particles for measuring the concentration was observed with transmission electron microscope (TEM), and the diameter having the maximum length was specified. Next, two intersection points of the diameter and the grain boundary were specified. Then, the total RH concentration in a region of 20 nm×20 nm centered on a midpoint of the two intersection points were measured, and defined as the total RH concentration $C_{RC}$ in the core part.

Next, one of the two intersection points was selected. Then, the total RH concentration in a region of 20 nm×20 nm centered at the point, penetrating the reverse core-shell main phase particle side by 20 nm apart from the intersection point along the diameter having the maximum length, was measured and referred to as the total RH concentration $C_{RS}$ in the shell part.

Further, in Examples 1 to 11 and 14 and Comparative Examples 1 and 2, the existence ratio ($r_s$) (%) of the particles including the low RH crystal phases in the magnet surface layer part having the magnetic pole surface and the existence ratio (re) (%) of the low RH crystal phases in the magnetic central part were measured by SEM, SEM-EDS, TEM and TEM-EDS. Specifically, 10 main phase particles were selected from each of the magnet surface layer part having the magnetic pole surface and the magnet central part, and it was measured how many of the 10 particles included the low RH crystal phase. The results are shown in Table 4.

Furthermore, in Examples 1 to 11 and 14 and Comparative Examples 1 and 2, the ratio ($r_{sh}$) (%) of the particles including the low RH crystal phases and the nonmagnetic R-rich phases in the magnet surface layer part and the existence ratio ($r_{ch}$) (%) of the low RH crystal phases and the nonmagnetic R-rich phases in the magnet central part were measured by SEM, SEM-EDS, TEM and TEM-EDS. The results are shown in Table 4.

TABLE 1

| Composition of raw material alloy | Nd | Al | Co | Cu | Zr | B | Tb | Fe |
|---|---|---|---|---|---|---|---|---|
| | wt % | | | | | | | |
| Alloy A (Exs. 1 to 14, Comp. Exs. 1, 3, 4) | 30.5 | 0.2 | 0.5 | 0.1 | 0.15 | 1.01 | 0.0 | Bal. |
| Alloy B (Comp. Ex. 2) | 31.0 | 0.2 | 0.0 | 0.0 | 0.17 | 1.11 | 0.0 | Bal. |
| Alloy C (Comp. Ex. 2) | 24.0 | 0.0 | 5.0 | 1.0 | 0.00 | 0.00 | 5.0 | Bal. |

TABLE 2

| Composition of Sintered Magnet Before Grain Boundary Diffusion | Nd | Al | Co | Cu | Zr | B | Tb | Fe |
|---|---|---|---|---|---|---|---|---|
| | wt % | | | | | | | |
| Exs. 1 to 14, Comp. Exs. 1, 3, 4 | 30.5 | 0.2 | 0.5 | 0.1 | 0.15 | 1.01 | 0.0 | Bal. |
| Comp. Ex. 2 | 30.3 | 0.2 | 0.5 | 0.1 | 0.15 | 1.00 | 0.5 | Bal. |

TABLE 3

| | Decomposition | Grain Boundary Diffusion | RH adherence to both magnetic pole surfaces | RH adherence to four surfaces except for both magnetic pole surfaces | Rapid Cooling | Residual Magnetic Flux Density Br (mT) | Coercive Force HcJ (kA/m) | Squareness Ratio Hkc/HcJ |
|---|---|---|---|---|---|---|---|---|
| Ex. 1 | Done | Done | Done | Done | Done | 1420 | 1850 | 0.97 |
| Ex. 2 | Done | Done | Done | Done | Done | 1420 | 1840 | 0.96 |
| Ex. 3 | Done | Done | Done | Done | Done | 1420 | 1830 | 0.95 |
| Ex. 4 | Done | Done | Done | Done | Done | 1420 | 1840 | 0.96 |
| Ex. 5 | Done | Done | Done | Done | Done | 1420 | 1830 | 0.95 |
| Ex. 6 | Done | Done | Done | Done | Done | 1420 | 1810 | 0.95 |
| Ex. 7 | Done | Done | Done | Done | Done | 1400 | 1850 | 0.96 |
| Ex. 8 | Done | Done | Done | Done | Done | 1380 | 1840 | 0.96 |
| Ex. 9 | Done | Done | Done | Done | Done | 1400 | 1810 | 0.95 |
| Ex. 10 | Done | Done | Done | Done | Done | 1400 | 1830 | 0.98 |
| Ex. 11 | Done | Done | Done | Done | Done | 1420 | 1790 | 0.95 |
| Ex. 14 | Done | Done | Done | Done | Done | 1410 | 1800 | 0.95 |
| Comp. Ex. 1 | Not Done | Done | Done | Done | Done | 1420 | 1770 | 0.90 |
| Comp. Ex. 2 | Not Done | Not Done | Not Done | Not Done | Not Done | 1370 | 1290 | 0.91 |

TABLE 4

| | Crystal Orientation | Crystal Orientation | Thickness of the low | Existence Ratio (%) of the Reverse Core Shell Particles in the Magnet Surface Layer | Existence Ratio (%) of the Reverse Core Shell | Ratio (%) of the Reverse Core Shell | Ratio (%) of the Reverse Core Shell | Low RH Crystal Phase | | Low RH crystal phases + nonmagnetic R-rich phases | |
|---|---|---|---|---|---|---|---|---|---|---|---|
| | Degree (%) of the Magnetic Polar Surface | Degree (%) of the Magnetic Central Part | crystal orientation degree layer (μm) | Part of Magnetic Polar Surface (%) | Particles in the Magnet Central Part | Particles Satisfying $C_{RC}/C_{RS} > 1.5$ | Particles Satisfying $C_{RC}/C_{RS} > 3.0$ | Surface Layer Part $r_s$ (%) | Central Part $r_c$ (%) | Surface Layer Part $r_{sh}$ (%) | Central Part $r_{ch}$ (%) |
| Ex. 1 | 58 | 65 | 30 | 100 | 0 | 100 | 100 | 90 | 0 | 80 | 0 |
| Ex. 2 | 59 | 65 | 30 | 80 | 0 | 100 | 100 | 70 | 0 | 70 | 0 |
| Ex. 3 | 60 | 65 | 20 | 70 | 0 | 100 | 100 | 70 | 0 | 70 | 0 |
| Ex. 4 | 59 | 65 | 30 | 80 | 0 | 100 | 100 | 60 | 0 | 60 | 0 |
| Ex. 5 | 58 | 65 | 20 | 70 | 0 | 100 | 86 | 60 | | 60 | 0 |
| Ex. 6 | 58 | 65 | 10 | 60 | 0 | 83 | 67 | 40 | 0 | 30 | 0 |
| Ex. 7 | 58 | 65 | 60 | 100 | 0 | 100 | 100 | 90 | 0 | 70 | 0 |
| Ex. 8 | 58 | 65 | 200 | 100 | 0 | 90 | 80 | 80 | 0 | 50 | 0 |
| Ex. 9 | 60 | 65 | 30 | 70 | 0 | 86 | 71 | 50 | 0 | 40 | 0 |
| Ex. 10 | 58 | 65 | 30 | 80 | 0 | 88 | 75 | 60 | 0 | 40 | 0 |
| Ex. 11 | 58 | 65 | 30 | 0 | 0 | | | 50 | 0 | 40 | 0 |
| Ex. 14 | 62 | 65 | 10 | 20 | 0 | 50 | 0 | 30 | 0 | 40 | 0 |
| Comp. Ex. 1 | 65 | 65 | | 0 | 0 | | | 20 | 10 | 10 | 0 |
| Comp. Ex. 2 | 64 | 64 | | 0 | 0 | | | 20 | 20 | 10 | 10 |

Tables 1 to 4 show that the crystal orientation degree of the main phase particles in the magnetic surface layer part having the magnetic pole surface (C surface) were lower than the same of the main phase particles in the magnetic central part in the R-T-B based sintered magnets of Examples 1 to 11, 14, which went through the step of decomposing and making finely structured main phase particles of the magnet surface layer part after sintering, the step of incorporating RH into the finely structured particles by the grain boundary diffusion, and the step of recombining the particles in which RH is incorporated by a rapid cooling. The residual magnetic flux density Br, coercive force Hcj and the squareness ratio Hk/Hcj thereof were all preferable.

Further, magnets in Examples 1 to 7, 9 to 11 and 14 having the thickness of 10 μm or more and 70 μm or less of the low crystal orientation degree layer showed further preferable residual magnetic flux density Br. Further, Examples 1 to 5, 7 and 8, in which the reverse core-shell main phase particles exist and ratio of the reverse core-shell main phase particles having $C_{RC}/C_{RS}>1.5$ among the reverse core-shell main phase particles was 90% or more, showed more preferable coercive force Hcj.

Examples 1 to 11 and 14 in which $r_s-r_c\geq 20\%$ showed preferable residual magnetic flux density Br and coercive force Hcj. In addition, Examples 1 to 5 and 7 in which $r_{sh}-r_{ch}\geq 60\%$ showed preferable residual magnetic flux density Br and coercive force Hcj.

On the other hand, the magnets of Comparative Examples 1 to 11, 14, which did not go through the step of finely decomposing the main phase particles of the magnet surface layer part after sintering, the step of incorporating RH into the finely structured particles by the grain boundary diffusion, and the step of recombining the particles in which RH is incorporated by a rapid cooling, the crystal orientation degree of the magnetic surface layer part did not decrease. As a result, the residual magnetic flux density Br, coercive force Hcj and/or the squareness ratio Hk/Hcj thereof were inferior to the same of Examples 1 to 11 and 14.

Comparative Example 1 did not go through the step of finely decomposing the main phase particles of the magnet surface layer part after sintering. Thus, RH was not incorporated in the main phase particle even the grain boundary diffusion and the rapid cooling were carried out, and the crystal orientation degree did not decrease. According to Comparative Example 2, the sintered magnet was produced by the two-alloy method. Then, the crystal orientation degree of the main phase particle in the magnet surface layer part and the crystal orientation degree of the main phase particle in the magnet central part were equal. As a result, the residual magnetic flux density Br, coercive force Hcj and/or the squareness ratio Hk/Hcj thereof were inferior to the same of Examples 1 to 11 and 14.

The results of comparing Example 12 with Comparative Example 3 are shown in Table 5, and the results of comparing Example 13 with Comparative Example 4 are shown in Table 6.

Table 5 shows whether the decomposition for decomposing, grain boundary diffusion, and rapid cooling after the grain boundary diffusion were carried out to the main phase particles present in the surface layer part of the R-T-B based sintered magnet of Example 12 and comparative Example 3. "Done" is given when each process was performed, "Not Done" is given when each process was not performed. Table 5 shows the evaluation results of the magnetic properties of residual magnetic flux density Br, coercive force Hcj and squareness ratio Hk/Hcj by B-H tracer. According to Example 12 and Comparative Example 3 in which RH was not grain boundary diffused, Hcj of 1250 kA or more was determined preferable.

Table 6 shows whether the decomposition for decomposing, grain boundary diffusion, and rapid cooling after the grain boundary diffusion were carried out to the main phase particles present in the surface layer part of the R-T-B based sintered magnet of Example 13 and Comparative Example 4. "Done" is given when each process was performed, "Not Done" is given when each process was not performed. It also shows whether RH was adhered to both magnetic pole surfaces (C surface) of the sintered magnet and whether RH was adhered to the four surfaces except for the both magnetic pole surfaces (C surface) of the sintered magnet in each Examples and Comparative Examples. "Done" is given when RH is adhered to the both magnetic pole surfaces or to the four surfaces except for the both magnetic pole surfaces and "Not Done" is given when RH is not adhered to each of the above surfaces. Table 6 shows the evaluation results of the magnetic properties of residual magnetic flux density Br, coercive force Hcj and squareness ratio Hk/Hcj by B-H tracer.

TABLE 5

| | Decomposition | Grain Boundary Diffusion | Rapid Cooling | Crystal Orientation Degree (%) of Magnetic Surface Layer | Crystal Orientation Degree (%) of Magnetic Central Part | Residual Magnetic Flux Density Br (mT) | Coercive Force HcJ (kA/m) | Squareness Ratio Hkc/HcJ |
|---|---|---|---|---|---|---|---|---|
| Ex. 12 | ○ | ○ | ○ | 61 | 65 | 1430 | 1284 | 0.97 |
| Comp. Ex. 3 | x | ○ | ○ | 65 | 65 | 1430 | 1173 | 0.90 |

TABLE 6

| | Decomposition | Grain Boundary Diffusion | RH adherence to both magnetic pole surfaces | RH adherence to four surfaces except for both magnetic pole surfaces | Rapid Cooling | Crystal Orientation Degree (%) of Magnetic Pole Surfaces | Crystal Orientation Degree (%) of Magnetic Central Part | Residual Magnetic Flux Density Br (mT) | Coercive Force HcJ (kA/m) | Squareness Ratio Hkc/HcJ |
|---|---|---|---|---|---|---|---|---|---|---|
| Ex. 1 | Done | Done | Done | Done | Done | 58 | 65 | 1420 | 1850 | 0.97 |
| Ex. 13 | Done | Done | Done | Done | Done | 56 | 65 | 1420 | 1970 | 0.98 |
| Comp. Ex. 4 | Done | Done | Not Done | Done | Done | 64 | 65 | 1420 | 1480 | 0.86 |

Table 5 show that the magnet of Example 12, which went through the step of finely decomposing the main phase particles of the magnet surface layer part after sintering, the step of incorporating Nd into the finely structured particles by the grain boundary diffusion, and the step of recombining the particles in which Nd is incorporated by a rapid cooling, improved coercive force Hcj and the squareness ratio Hk/Hcj in relative to the magnet of Comparative Example 3 in which the step of finely decomposing the main phase particles of the magnet surface layer part after sintering was not carried out. That is, even when heavy rare earth elements are not grain boundary diffused, it is possible to decrease the crystal orientation degree on the magnetic surface and improve coercive force Hcj and squareness ratio Hk/Hcj by going through the step of finely decomposing the main phase particles of the magnet surface layer part after sintering, the step of incorporating Nd into the finely structured particles by the grain boundary diffusion, and the step of recombining the particles in which Nd is incorporated by a rapid cooling.

Table 6 shows that Example 13 greatly improved coercive force Hcj in relative to Comparative Example 4. Tb was adhered only to both magnetic pole surfaces of Example 13 while Tb was adhered only to the four surfaces except for both magnetic pole surfaces in Comparative Example 4. That is, it is possible to improve the coercive force Hcj by incorporating RH into the magnetic pole surface (C surface) to reduce the crystal orientation degree of the main phase particle in the magnet surface layer part having the magnetic pole surface. The improvement in coercive force was observed in Example 13 than in Example 1. It is considered that this is due to the followings. Tb amount adhered to the magnetic pole surface was larger in Example 13 than in Example 1 and a decreasing amount in the crystal orientation degree of the main phase particles in the magnetic surface layer part having magnetic pole surface was larger in Example 13 than in Example 1.

EXPLANATION OF REFERENCES

1: R-T-B based sintered magnets
1*a*: Magnetic surface layer part having magnetic pole surfaces
1*b*: Magnetic central parts
11: Main phase particles
11*a*: Low crystal oriented main phase particles
11*b*: High crystal oriented main phase particles
12: Grain boundaries
110: Nonuniform reverse core-shell main phase particles
110*a*: Core part
110*b*: Shell part
210: Low RH crystal phase
230: Nonmagnetic R-rich phase

The invention claimed is:

1. An R-T-B based sintered magnet including a plural number of main phase grains comprising an $R_2T_{14}B$ crystal structure, wherein R is at least one rare earth element, T is at least one transition metal element comprising Fe or Fe and Co, and B is boron, the R-T-B based sintered magnet comprises a magnet surface layer part and a magnet central part existing inside the magnet surface layer part, a crystal orientation degree of the main phase grain in the magnet surface layer part having a magnetic pole surface is lower than the crystal orientation degree of the main phase grain in the magnet central part, the R-T-B based sintered magnet comprises a low crystal orientation degree layer where a crystal orientation degree is decreased by 2% or more with respect to the crystal orientation degree in the magnet central part, and crystal orientation degree is calculated by Lotgering method based on the X-ray diffraction intensity I (001) of the component of (001) reflection and the X-ray diffraction intensity I (hk0) of the component of (hk0) reflection, the crystal orientation degree fc can be calculated by the following equation 1:

$$fc = \frac{\sum I(00l)}{\sum I(hk0)} \times 100. \quad \text{[Equation 1]}$$

2. The R-T-B based sintered magnet according to claim 1, wherein

R is at least one rare earth element comprising a heavy rare-earth element RH, and at least one of the main phase grains included in the magnet surface layer part is a reverse core-shell main phase grain comprising a core part and a shell part in which the shell part covers the core part, wherein $C_{RC}/C_{RS}>1.0$ is satisfied when a total concentration (at %) of all RH elements in the core part is defined as $C_{RC}$ and a total concentration (at %) of all RH elements in the shell part is defined as $C_{RS}$.

3. The R-T-B based sintered magnet according to claim 2, wherein the core part comprises a low RH crystal phase, and the low RH crystal phase comprises the $R_2T_{14}B$ crystal structure, wherein an RH concentration in the low RH crystal phase is relatively lower than an RH concentration in the plural number of main phase grains, and which satisfies N1−L1 ≥0.5 when the total RH concentration (at %)/the total RL concentration (at %) in the low RH crystal phase is represented by L1 and the total RH concentration (at %)/the total RL concentration (at %) in the main phase existing around the low RH crystal phase is represented by N1.

4. The R-T-B based sintered magnet according to claim 3, wherein the core part further comprises a nonmagnetic R-rich phase.

5. The R-T-B based sintered magnet according to claim 2, wherein total RH concentration with respect to the total R concentration in the core part of the reverse core-shell main phase grains is about 30% or more and 80% or less in an atomic ratio, and the total RH concentration with respect to the total R concentration in the shell part of the reverse core-shell main phase grains is about 10% or more and 30% or less in the atomic ratio.

6. The R-T-B based sintered magnet according to claim 2, wherein $C_{RC}/C_{RS}>3.0$.

7. The R-T-B based sintered magnet according to claim 1, which has a residual magnetic flux density Br of 1380 mT or more.

8. The R-T-B based sintered magnet according to claim 7, wherein the residual magnetic flux density Br is 1400 mT or more.

9. The R-T-B based sintered magnet according to claim 1, which has a coercive force Hcj of 1790 kA/m or more.

10. The R-T-B based sintered magnet according to claim 9, wherein the coercive force Hcj is 1830 kA/m or more.

11. The R-T-B based sintered magnet according to claim 1, which has a squareness ratio Hk/Hcj of 0.95 or more.

* * * * *